US006475031B1

(12) United States Patent
Wu

(10) Patent No.: US 6,475,031 B1
(45) Date of Patent: Nov. 5, 2002

(54) ELECTRICAL CONNECTOR HAVING IMPROVED RETENTION DEVICES

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/908,121

(22) Filed: Jul. 17, 2001

(51) Int. Cl.[7] ..... H01R 13/73
(52) U.S. Cl. ..... 439/570
(58) Field of Search ..... 439/570, 569, 439/571, 572, 573, 83

(56) References Cited

U.S. PATENT DOCUMENTS 5,186,654 A * 2/1993 Enomoto et al. ..... 439/570
5,385,478 A * 1/1995 Niekawa ..... 439/570
6,012,949 A * 1/2000 Lok ..... 439/570
6,152,766 A * 11/2000 Wu et al. ..... 439/570
6,227,907 B1 * 5/2001 Wu et al. ..... 439/570

* cited by examiner

*Primary Examiner*—Hien Vu
(74) *Attorney, Agent, or Firm*—Wei Te Chung

(57) ABSTRACT

An electrical connector (1) includes an insulative housing (10) retaining a number of contacts (12) in the housing and a pair of fasteners (16) retained to opposite sides of the housing. The housing defines a pair of recesses (26) at conjunction of corresponding side faces (24) of the housing and a mounting surface (20). Each recess includes a first peripheral wall (28) parallel with and adjacent to a mating surface (18) of the housing. The housing provides a pair of cantilever beams (26) each extending rearwardly from a corresponding first peripheral wall in a corresponding recess. The fasteners are securely received in corresponding recesses and urged by corresponding cantilever beams. The first peripheral wall defines a slot (50) therein fixedly receiving an interference section (48) of the fastener therein. Thus, the fasteners are reliably retained to the housing.

6 Claims, 4 Drawing Sheets

ELECTRICAL CONNECTOR HAVING IMPROVED RETENTION DEVICES

BACKGROUND OF THE INVENTION

1. Field of the Invention

The present invention relates to a connector, and particularly to a connector having improved retention devices for securely retaining the connector onto a printed circuit board.

2. Description of the Related Art

Electrical connectors are usually mounted onto a printed circuit board before engaging with mating electronic components. The contacts of the connector are mounted to conductive trails on the printed circuit board by solders via through hole or surface mount technology (SMT) approaches. When the connector mates with a mating connector, the contacts suffer a large force at connections of the contacts and the conductive trails, which may destroy the connections. In order to avoid such condition to happen, retention means are applied to the housing. The retention means are fastened to an insulative housing of the connector and have a portion mountable on the printed circuit board by solder balls via through hole or SMT approaches. For example, U.S. Pat. No. 6,231,386 discloses a connector mounted onto a printed circuit board by a pair of L-shaped retention means. The connector has an insulative housing defining a mating port and contact receiving slots therein and a pair of slits at opposite portions thereof. However, the contact receiving slots and the slits of the housing extend in crossed or perpendicular directions, which may complicate the manufacture of the connector. U.S. Pat. No. 6,024,602 discloses another connector retained to a printed circuit board by a pair of retention means. Each retention means includes a body portion and a flange laterally extending from the body portion and a pair of locking legs downwardly extending from the body portion. The housing defines two slits at opposite sides thereof for receiving respective retaining means. U.S. Pat. No. 5,971,802 again discloses a connector including an insulative housing and a clip retained to a block at each of two opposite side faces thereof. Each clip has a pair of spring legs clipping opposite side faces of the corresponding block thereby retaining the clip to the block. The above mentioned three patents each disclose solutions of retaining the connectors to printed circuit boards. However, such solutions still have some disadvantages. The present invention is aimed to provide an improved electrical connector to overcome the disadvantages of the prior art.

SUMMARY OF THE INVENTION

An object of the present invention is to provide an electrical connector having improved retention devices for securely fastening the electrical connector onto a printed circuit board.

To obtain the above object, an electrical connector includes an insulative housing retaining a number of contacts in the housing and a pair of fasteners retained to opposite sides of the housing. The housing defines a pair of recesses at conjunction of corresponding side faces of the housing and a mounting surface. Each recess includes a first peripheral wall parallel with and adjacent to a mating surface of the housing. The housing provides a pair of cantilever beams each extending rearwardly from a corresponding first peripheral wall in a corresponding recess. The fasteners are securely received in corresponding recesses and urged by corresponding cantilever beams. The first peripheral wall defines a slot therein fixedly receiving an interference section of the fastener therein. Thus, the fasteners are reliably retained to the housing.

In a detail of the invention, each fastener includes a body portion and a flange and a mounting tab laterally extending from upper and lower edges of the body portion and the interference section at a front thereof. The flange and the mounting tab respectively urge the top edge and a lower edge of the cantilever beam thereby clamping the cantilever beam. The mounting tab has a mounting face parallel with the mounting surface of the insulative housing.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
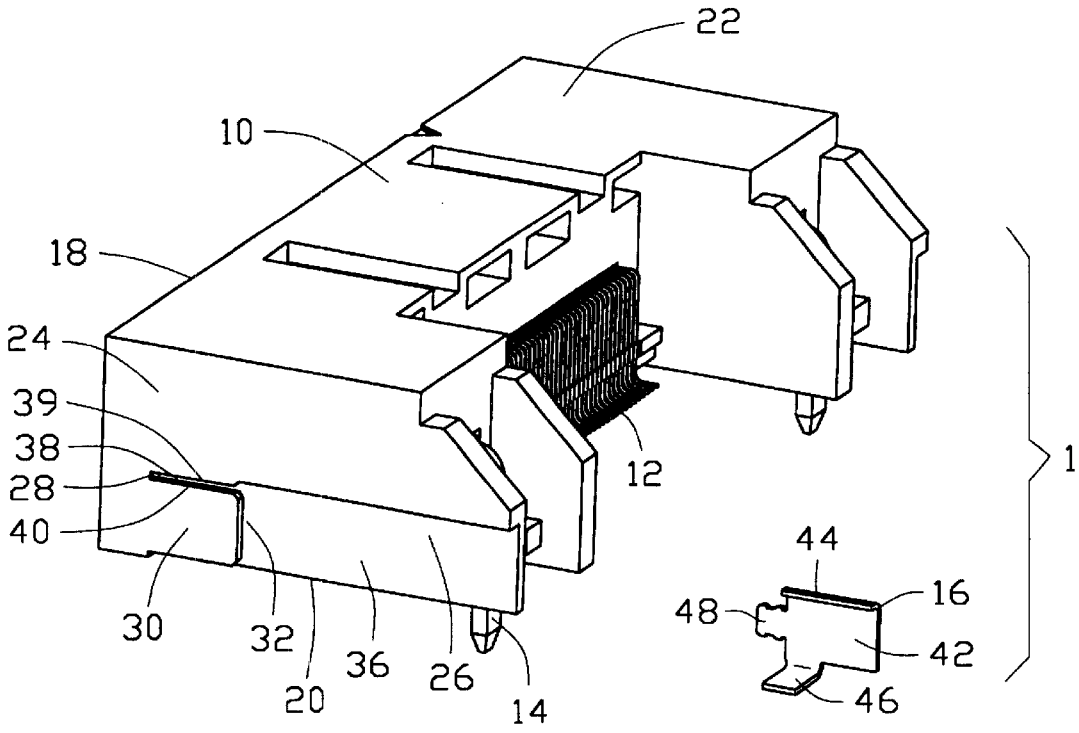
FIG. 1 is a rear perspective view of an electrical connector in accordance with the present invention wherein one fastener is disassembled from an insulative housing of the connector.
Figure 2:
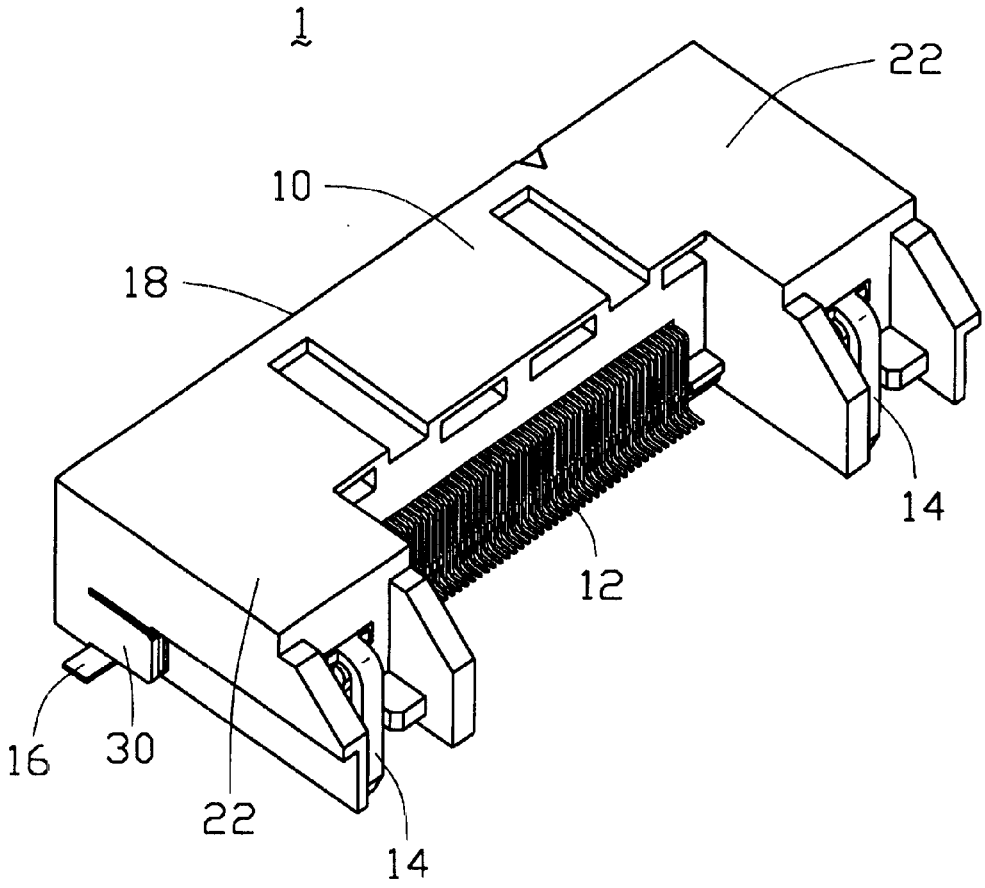
FIG. 2 is a view similar to FIG. 1 but the fastener is assembled to the housing.
Figure 3:
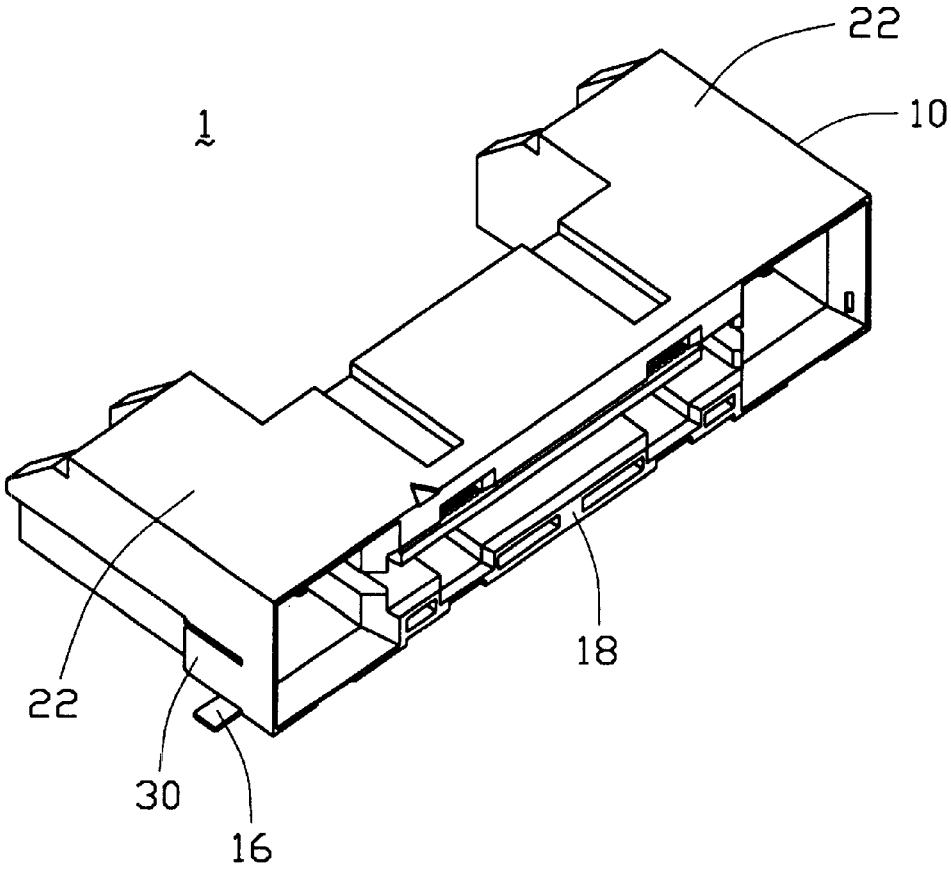
FIG. 3 is a front perspective view of the electrical connector.

Referring to FIGS. 1, 2 and 3, an electrical connector 1 in accordance with the present invention includes an insulative housing 10, a plurality of terminals 12 retained to the housing 10, two power contacts 14 retained to the housing 10 and a pair of fasteners 16 assembled to two opposite sides of the housing 10.

Figure 4:
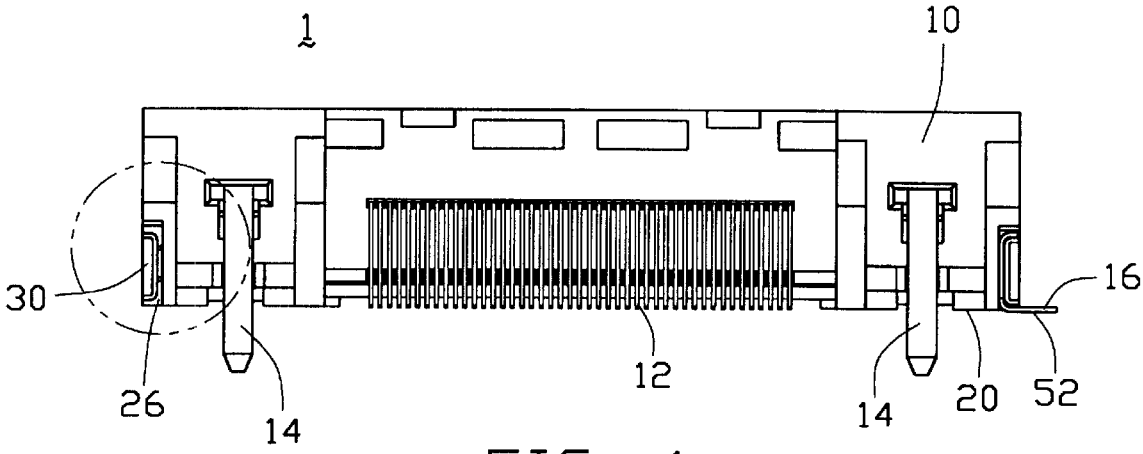
FIG. 4 is a rear planar view of the electrical connector in FIG. 1 without the disassembled fastener.

Referring particularly to FIG. 1, the housing 10 includes a mating surface 18 at a front thereof, a mounting surface 20 at a bottom thereof and a pair of retention portions 22 at the respective two opposite sides thereof. Each retention portion 22 includes a side face 24 at an outermost section thereof and defines a recess 26 at conjunction of the side face 24 and the mounting surface 20. The recess 26 extends toward the mating surface 18 of the housing 10 and terminates at a first peripheral wall 28 thereof. A cantilever beam 30 rearwardly extends from the first peripheral wall 28 in the recess 26 and does not substantially extend beyond the side face 24 in a longitudinal direction of the housing 10 (shown by arrows in FIG. 1). Also referring to FIGS. 4 and 5, the recess 26 has a second peripheral wall 36 generally parallel with the side face 24 of the housing 10 and a gap 32 is defined between the second peripheral wall 36 and an inner surface 34 of the cantilever beam 30. The recess 26 further has a third peripheral wall 39 generally parallel with the mounting surface 20 of the housing 10 and a slit 38 is defined between the third peripheral wall 39 a top edge 40 of the cantilever beam 30. The gap 32 and the slit 38 isolate the cantilever beam 30 from the remainder of the housing 10 except at the first peripheral wall 28. A slot 50 is defined in each first peripheral wall 28 and communicating a corresponding recess 26 for receiving an interference section 48 of the faster 16.

As clearly shown in FIG. 1, each fastener 16 includes a body portion 42, a flange 44 and a mounting tab 46 respectively laterally extending from an upper and a lower edges of the body portion 42, and the interference section 48 with barbs thereon at a front thereof. The fastener 16 is U-shaped if looking from a proper perspective.

Figure 5:
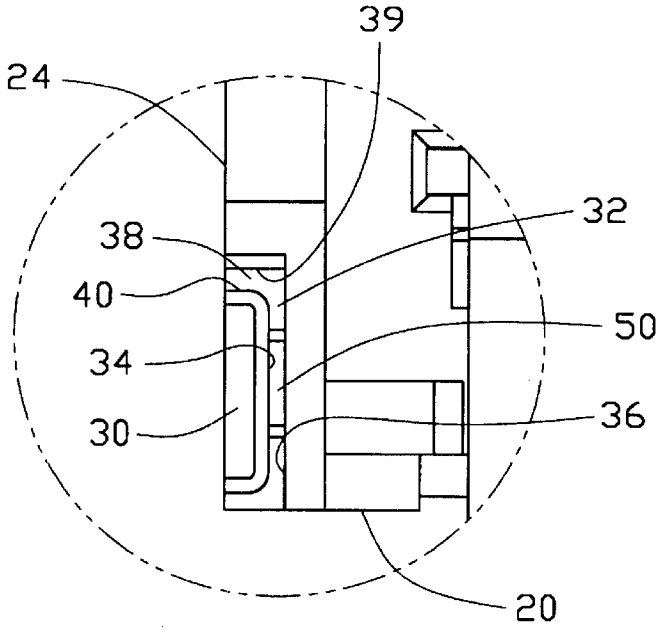
FIG. 5 is a partial enlarged view of a section circled by a circle in FIG. 4.

Referring to FIGS. 1, 2 and 5, the pair of fasteners 16 are forwardly assembled to the opposite retention portions 22 of the housing in a direction perpendicular to the mating surface 18. The body portion 42 is sandwiched between the inner surface 34 of the cantilever beam 30 and the second peripheral wall 36 of the recess 26. The flange 44 is securely received in the slit 38 and the interference section 48 is fixedly received in the slot 50. The mounting tab 46 is located under the cantilever beam 30 and has a mounting face 52 parallel with the mounting surface 20 of the housing.

It is to be understood, however, that even though numerous characteristics and advantages of the present invention have been set forth in the forgoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing receiving a plurality of terminals therein, the housing defining a recess at conjunction of side and bottom faces thereof, the recess extending toward a mating surface of the housing and terminated at a first peripheral wall thereof, the first peripheral wall defining a slot extending toward the mating surface and communicating with the recess; and a fastener securely received in the recess and having an interference section fixedly retained in the slot;

wherein the housing provides a cantilever beam extending in the recess from the first peripheral wall in a direction away from the mating surface of the housing, the fastener being retained to the cantilever beam;

wherein the recess provides a second peripheral wall parallel with the side face of the housing and a body portion of the fastener is received in a gap defined between an inner surface of the cantilever beam and the second peripheral wall;

wherein the recess provides a third peripheral wall generally parallel with the bottom face of the housing and a flange of the fastener, laterally extending from the body portion, is received in a slit defined between a top edge of the cantilever beam and the third peripheral wall.

2. The electrical connector as claimed in claim 1, wherein the cantilever beam does not extend beyond corresponding side face of the housing.

3. The electrical connector as claimed in claim 1, wherein the fastener includes the body portion, the flange, the interference section at a front thereof and a mounting tab laterally extending from the body portion.

4. The electrical connector as claimed in claim 3, wherein the fastener has a U-shaped configuration.

5. The electrical connector as claimed in claim 3, wherein the mounting tab has a mounting face parallel with a bottom surface of the housing.

6. An electrical connector comprising:

an insulative housing receiving a plurality of terminals therein;

a recess extending forwardly from a rear face and along a side face of the housing and terminated at a first peripheral wall thereof;

an exposed cantilever arm extending rearwardly from said first peripheral wall in a portion of said recess along a front-to-back direction of the housing;

a slit formed right above said cantilever arm and laterally exposed to an exterior; and a fastener including a vertical flat body dimensionally compliant with said cantilever arm and received within the recess along said portion, a flange outwardly and horizontally extending from a top edge of said flat body and received within said slit, an interferance section extending forwardly from a side end of flat body and toward the front direction of the housing, and a mounting tab outwardly horizontally extending from a bottom edge of said flat body parallel to said flange.

* * * * *